US006396014B1

(12) United States Patent
Minodier et al.

(10) Patent No.: US 6,396,014 B1
(45) Date of Patent: May 28, 2002

(54) DEVICE TO AMPLIFY THE MOVEMENT OF AN OPERATING BUTTON OF A SWITCH

(75) Inventors: Christian Minodier, Beaumont les Valence; Bernard Truchet, Besayes, both of (FR)

(73) Assignee: Crouzet Automatismes, Valence (FR)

( * ) Notice: Subject to any disclaimer, the term of this patent is extended or adjusted under 35 U.S.C. 154(b) by 0 days.

(21) Appl. No.: 09/696,966

(22) Filed: Oct. 27, 2000

(30) Foreign Application Priority Data

Oct. 29, 1999 (FR) ..... 99 13612

(51) Int. Cl.[7] ..... H01H 13/02
(52) U.S. Cl. ..... 200/332.1; 200/341
(58) Field of Search ..... 200/332.1, 337, 200/330, 331, 341, 345

(56) References Cited

U.S. PATENT DOCUMENTS 3,594,529 A * 7/1971 Cartwright ..... 200/330
4,556,768 A 12/1985 Atsumi et al.
4,740,661 A 4/1988 Nishikawa et al.
5,336,860 A * 8/1994 Slocum ..... 200/332.1
5,803,238 A * 9/1998 Roza ..... 200/332.1
6,103,983 A 8/2000 Truchet et al.

FOREIGN PATENT DOCUMENTS

| | | |
|---|---|---|
| DE | 197 04 611 | 8/1998 |
| DE | 198 08 060 | 9/1999 |
| FR | 2 785 985 | 5/2000 |

* cited by examiner

*Primary Examiner*—Renee Luebke
(74) *Attorney, Agent, or Firm*—Oblon, Spivak, McClelland, Maier & Neustadt, P.C.

(57) ABSTRACT

A device for amplifying the movement of an operating button of a switch, wherein the switch is fixed in a body of the device. The device includes a pusher that is translatable along an central longitudinal axis of the body. The translation of the pusher constitutes the amplified motion. The device also includes a varying-diameter cylindrical member, and a first support region. The first support region is capable of moving along a ramp of the pusher, when the pusher moves along the central longitudinal axis of the body. The varying-diameter cylindrical member includes a second support region in permanent contact with a region of the body, whatever the position of the pusher, and a third support region in contact with the operating button of the switch.

11 Claims, 3 Drawing Sheets

DEVICE TO AMPLIFY THE MOVEMENT OF AN OPERATING BUTTON OF A SWITCH

CROSS REFERENCE TO RELATED APPLICATIONS

This application is related to and claims priority, under 35 U.S.C. §119, from French Patent Application No. 99 13612, filed on Oct. 29, 1999, the entire contents of which is hereby incorporated by reference herein.

BACKGROUND OF THE INVENTION

1. Field of the Invention

The present invention relates to a device to amplify the movement of an operating button for a switch, which is used especially when the operating button of the switch has a small range of travel, for example, about one millimeter.

2. Discussion of Background

Switches, of the type discussed above, are used when fast selection switching is required, for example, to prevent rebounding between the contacts of the switch.

In a movement-amplifying device, the operating button is not operated directly, but by means of a pusher that is movable in translation and has a range of travel, for example, about 5 millimeters, which is far greater than the range of travel of the operating button, i.e., about 1 millimeter. The amplified range of travel of the pusher is especially useful for broadening the manufacturing tolerance values for mechanisms, such as a cam, for example, which operate the pusher.

The prior art movement-amplifying devices are complicated. They comprise a large number of mechanical parts, and especially several springs.

SUMMARY OF THE INVENTION

The present invention is aimed at simplifying the complicated movement-amplifying devices of the prior art.

To achieve this aim, an object of the present invention is to provide a device to amplify the movement of an operating button of a switch, wherein the switch is fixed in a body of the device. The device includes a pusher which is translatable along a central longitudinal axis of the body and the central longitudinal axis of the body is coincident with a central longitudinal axis of the pusher. The translation of the pusher constitutes the amplified motion. The device includes a varying-diameter cylindrical member having first, second, and third support regions. The first support region of the cylindrical member is capable of moving along a ramp of the pusher when the pusher moves along the central longitudinal axis of the body. The second support region of the cylindrical member is in permanent contact with a region of the body whatever the position of the pusher. The third support region of the cylindrical member is in contact with the operating button of the switch.

An advantage of the present invention is that the movement-amplifying device provides for the depressed and released positions of the pusher to be reversed from the depressed and released positions of the operating button of the switch. In other words, when the pusher is at rest or in a released position, the operating button of the switch is in a depressed position and when the pusher is in a depressed position, the operating button of the switch is in a released position. The reversed states of the depressed and released positions for the pusher and the operating button of the switch are advantageous, particularly for small-motion switches which cannot withstand the sudden action of having their operating button pressed upon because such sudden pressing action could cause damage to the switch. Because of the reversed states of the depressed and released positions of the pusher and the operating button of the switch, the speed with which the operating button is pressed is related to the structure for providing permanent contact between the second support region of the cylindrical structure and the region of the body, for example, by using a spring that maintains this contact. The calibration of this spring controls the speed at which the operating button is pressed and prevents sudden depressing of the operating button so that the switch will not be damaged.

Another advantage of the present invention is that the movement-amplifying device enables the progress of the travel of the operating button to be set as a function of the progress of travel of the pusher. This setting of the progress of the travel of the operating button of the switch as a function of the progress of travel of the pusher is obtained by adapting the shape of the ramp.

BRIEF DESCRIPTION OF THE DRAWING FIGURES

The present invention will be understood more clearly and other advantages will appear from the following detailed description of an embodiment illustrated by the appended drawing in which the different figures show several positions of the same device. More specifically:

For greater convenience, the same structural elements of the device will bear the same reference numerals in the different figures.

DETAILED DESCRIPTION OF THE PREFERRED EMBODIMENTS

Figure 1:
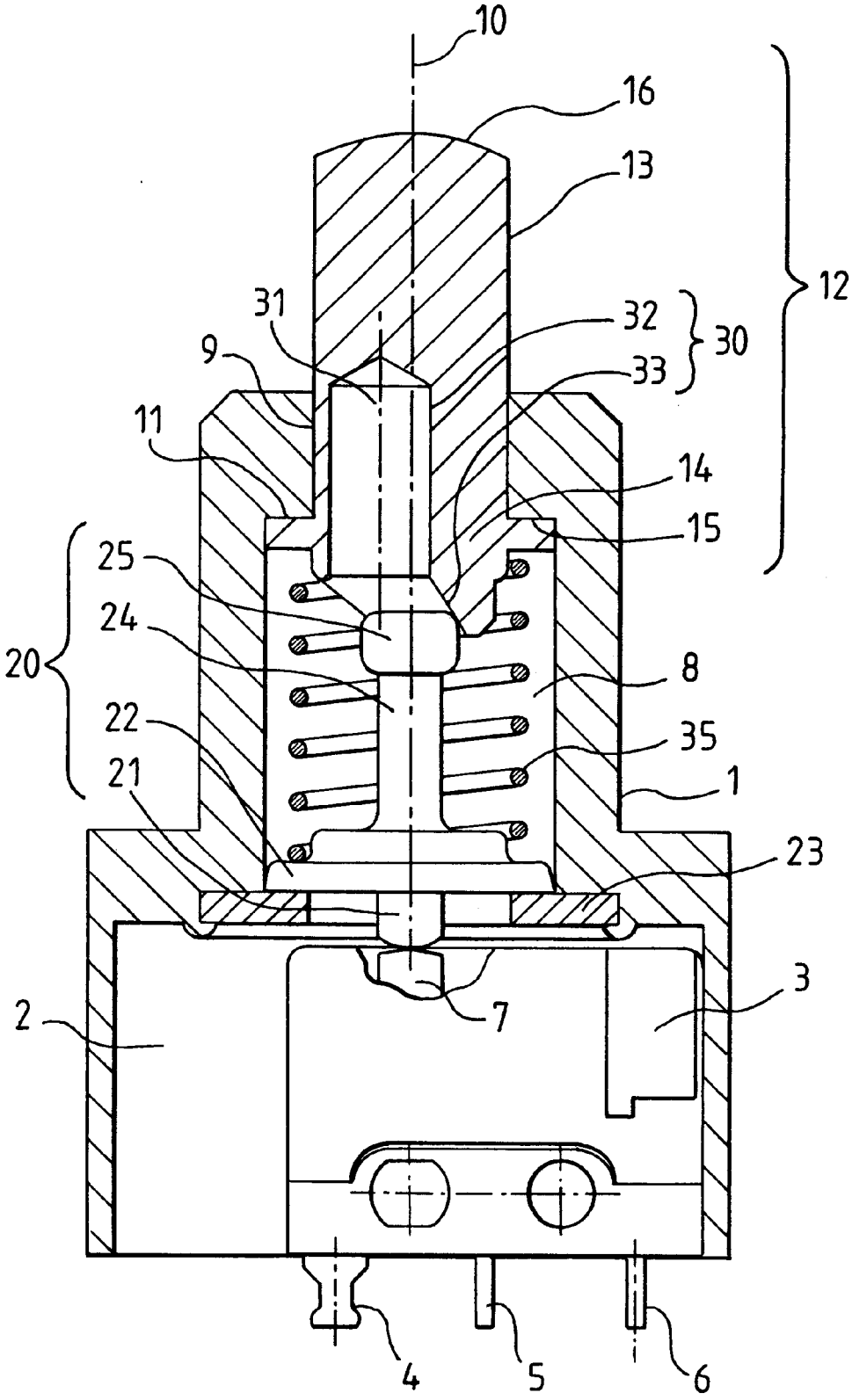
FIG. 1 is a cross-sectional view of a movement-amplifying device showing a pusher in a released position.

The different structural elements of the movement-amplifying device, according to the present invention, will now be described with reference to FIGS. 1–3. Referring to FIG. 1, a body 1 is shown and bears the other structural elements of the device. More particularly, the body 1 has a first cavity in which a switch 3 is fixed. The switch 3 has, for example, a parallelepiped shape. The lower part of the switch has electrical connection pins 4, 5, and 6. The upper part of the switch 3 has an operating button 7 capable of translation, for example, back and forth between several positions. The switch 3 sets up contact between certain ones of the pins 4, 5, and 6 of the switch 3 as a function of the position of the operating button 7. For example, the switch 3 has three pins 4, 5, and 6 and the operating button 7 can move between two positions, i.e., a depressed position and a released position. In the depressed position, the operating button 7 places the pins 4 and 5 of the switch 3 in contact and in the released position, the operating button 7 places the pins 4 and 6 of the switch 3 in contact. The operating button 7, shown in FIG. 1, is in a depressed position.

Of course, it is possible to implement the present invention with a switch 3 comprising several separate circuits and/or a switch 3 having operating button 7 which can take more than two positions, wherein each of the positions put different pins 4, 5, and 6 of the switch 3 into contact.

Above the first cavity 2, the body 1 has a second cavity 8 communicating with the first cavity 2. The second cavity 8 has an aperture 9 which opens out on the top of the body 1. The second cavity 8 and the aperture 9 are cylindrical, for example, along a central longitudinal axis 10 of the body 1 and the pusher 12. The diameter of the aperture 9 is smaller than the diameter of the second cavity 8 so that a shoulder 11 is formed inside of the body 1.

The device also comprises a pusher 12, substantially formed by a cylindrical part 13 along the central longitudinal axis 10 of the body 1 and an annular flange 15 at a lower end 14 of the cylindrical portion 13 of the pusher 12. The diameter of the annular flange 15 of the pusher 12 as well as the diameter of the cylindrical portion 13 are such that the cylindrical portion 13 can move freely in the aperture 9 until the annular flange 15 comes to abut the shoulder 11 formed between the second cavity 8 and the aperture 9, as is the case shown in FIG. 1. The cylindrical portion 13 of the pusher 12 extends along the central longitudinal axis 10 of the body 1 up to an end 16, which is located above the top surface of the body 1.

The device furthermore has a varying-diameter cylindrical member 20, which is substantially generated by revolution. The central longitudinal axis of the varying-diameter cylindrical member 20 is substantially coincident with the central longitudinal axis 10 of the body 1, when the device is in the position shown in FIG. 1. The varying-diameter cylindrical member 20 has a first finger 21. The first finger 21 has an end which is in contact with the operating button 7 of the switch 3.

Advantageously, the surface of the end of the finger 21 which is in contact with the surface of the operating button 7 are substantially convex so as to provide for a substantially localized contact.

The varying-diameter cylindrical member 20 furthermore has a flange 22 designed to press against a region of the body 1.

Advantageously, the external diameter of the flange 22 is substantially the same as the internal diameter of the second cavity 8 and a support region belonging to the body 1 is formed by an added-on part 23 fixed to the body 1 so that the varying-diameter cylindrical member 20 can be supported inside of the body 1.

The added-on part 23 is, for example, a flat washer crimped in the body 1. The internal diameter of this flat washer is smaller than the outer diameter of the flange 22. As an alternative, the added-on part 23 may also be an internal circlip mounted in a groove of the body 1. In that case, the internal diameter of the internal circlip would be, similar to the flat washer, smaller than the outer diameter of the flange 22. The varying-diameter cylindrical member 20 also has a second finger 24. An end 25 of the second finger 24 is supported against a ramp 30 belonging to the pusher 12. The first finger 21 and the second finger 24 both extend advantageously along the central longitudinal axis of the varying-diameter cylindrical member 20, which as shown in FIG. 1 is coincident with the central longitudinal axis 10 of the body, on either side of the flange 22.

Advantageously, the end 25 of the second finger 24 has a convex surface so that the support against the ramp 30 is substantially localized.

The ramp 30 is made, for example, by means of a bore made in the pusher 12. A central longitudinal axis 31 of the bore is parallel to and slightly offset from the central longitudinal axis 10 of the body 1. The bore comprises a smooth, cylindrical blind hole 32. The bore opens out on the lower end 14 side of the pusher 12 through a countersunk feature 33. In the embodiment shown in FIG. 1, the distance the central longitudinal axis 31 of the bore is offset from the central longitudinal axis 10 of the body 1 is such that a part of the countersunk feature 33 is located outside of the pusher 12.

The dimensions of the different parts comprising the device are such that when the pusher 12 is in the highest possible position, namely, when the annular flange 15 of the pusher 12 substantially contacts the shoulder 11 between the second cavity 8 and the aperture 9, the flange 22 is substantially supported on an entire perimeter thereof against the added-on part 23. Advantageously, an elastic element 35 is provided to ensure this support. This elastic element 35 is also used to make the annular flange 15 of the pusher 12 approach the shoulder 11 between the second cavity 8 and the aperture 9. The elastic element 35 is, for example, a helical spring placed between the pusher 12 and the flange 22. The central longitudinal axis of the helical spring is substantially merged with the central longitudinal axis 10 of the body 1.

It is clearly not possible to obtain perfect contact simultaneously between the flange 22 and the added-on part 23, the end 25 of the second finger 24 and the ramp 30, and the annular flange 15 and the shoulder 11 between the second cavity 8 and the aperture 9. Advantageously, a functional clearance is planned between the end 25 of the second finger 24 and the ramp 30. Thus, the other contacts will be obtained surely and precisely.

When the pusher 12 is in its highest possible position, the first finger 21 presses the operating button 7 of the switch 3 and holds it in the depressed position. When the contact between the flange 22 and the added-on part 23 is obtained with precision, the pressing of the first finger 21 and the operating button 7 is controlled with greater certainty.

Figure 2:
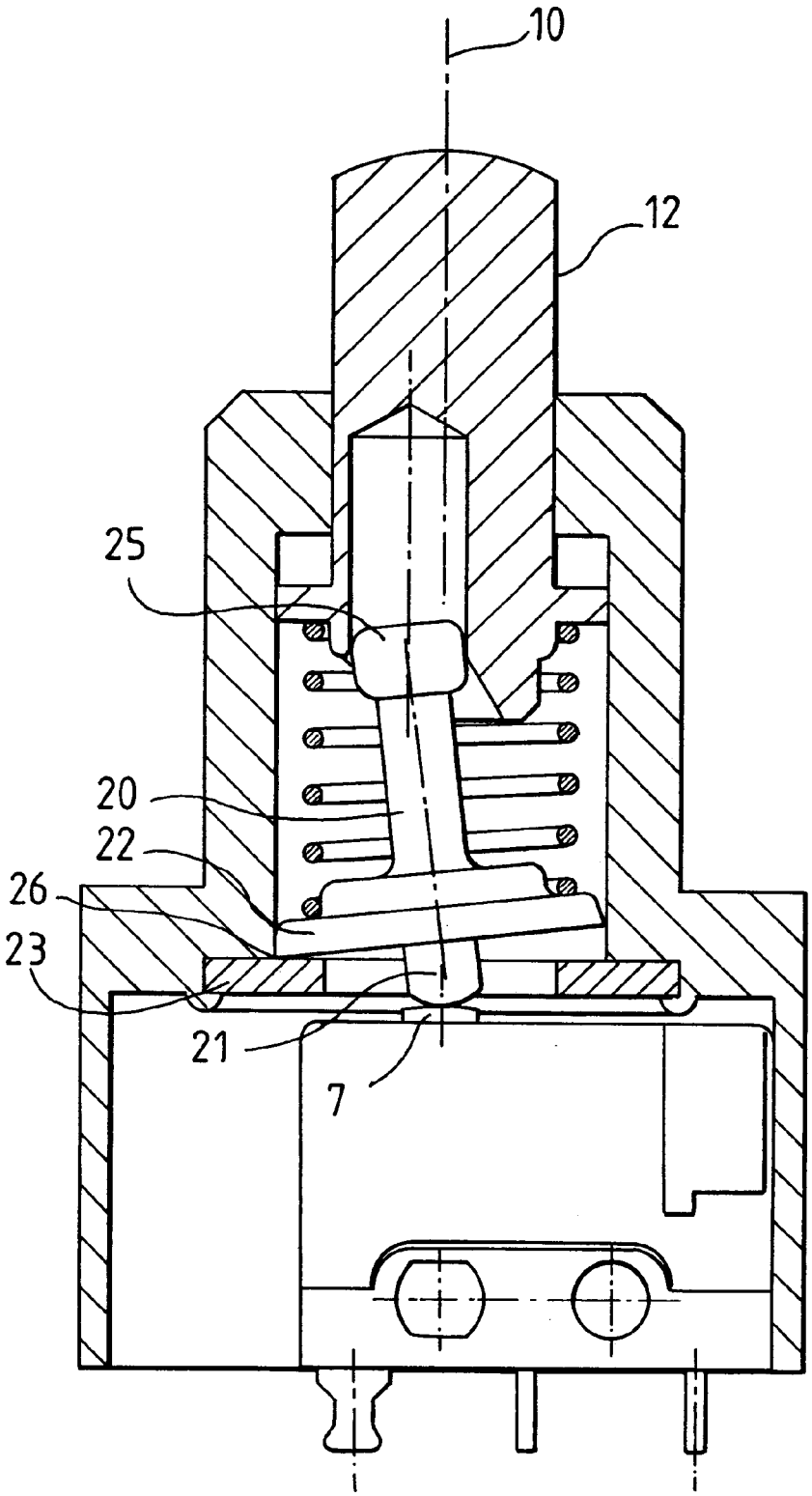
FIG. 2 is a cross-sectional view of the movement-amplifying device of FIG. 1 with the pusher in an intermediate position.
Figure 3:
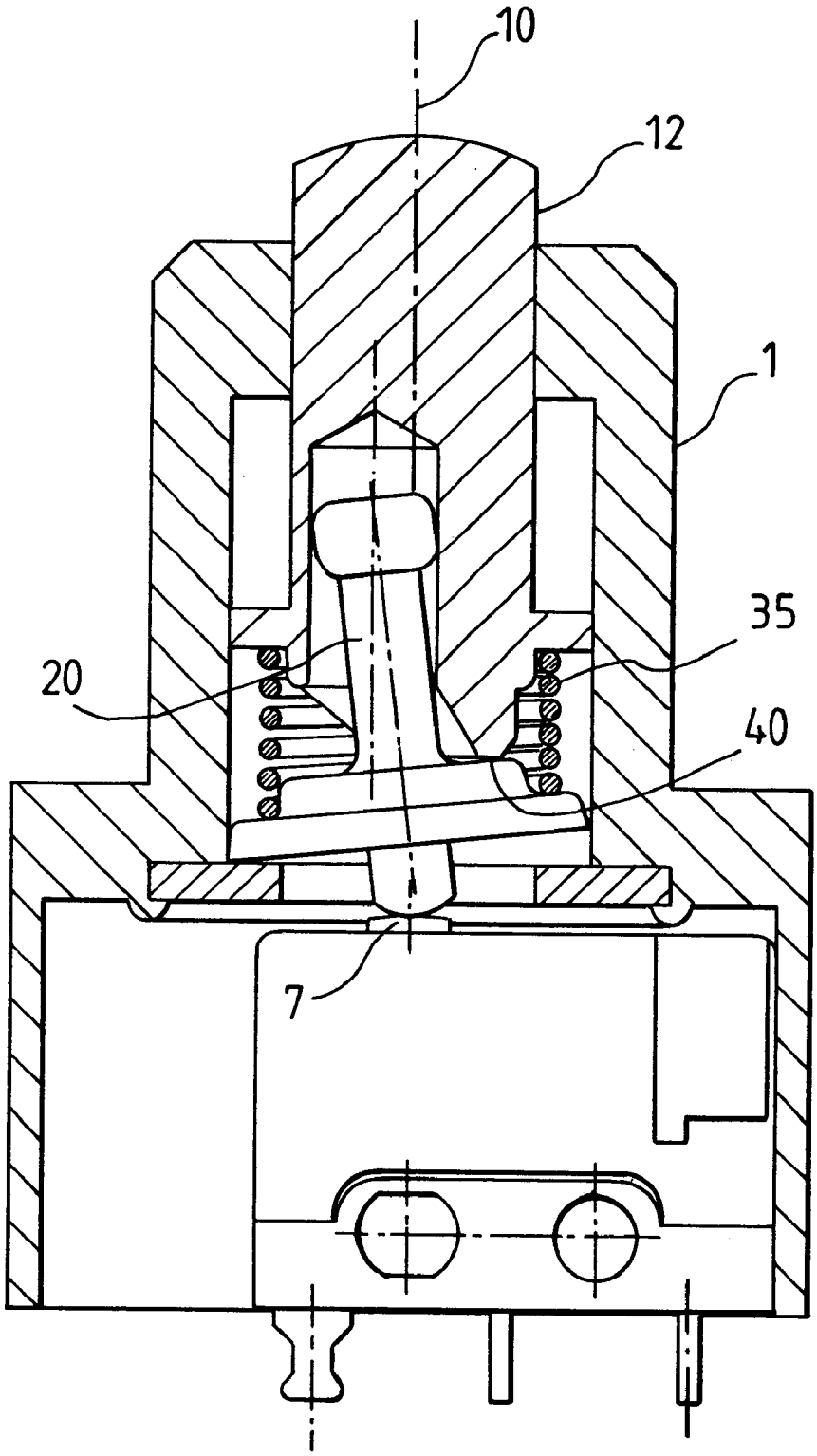
FIG. 3 is a cross-sectional view of the movement-amplifying device of FIG. 1 with the pusher in a depressed position.

FIG. 2 shows the structural element of the device shown in FIG. 1. Here the pusher 12 has been slightly pushed in along the central longitudinal axis 10 of the body 1. The difference between the positions of the pusher 12 shown in FIG. 1 and FIG. 2 is that the end 25 of the second finger 24 of the varying-diameter cylindrical member 20 has slid along the countersunk feature 33, and the flange 22 has become partially detached from the added-on part 23 so as to keep only a substantially localized contact 26 with the added-on part 23. The first finger 21 remains in contact with the operating button 7 of the switch 3, and when the operating button 7 of the switch is lifted, the operating button 7 of the switch 3 is placed in a released position.

The varying-diameter cylindrical member 20 pivots about the substantially localized contact 26 when the pusher 12 is depressed. It is not necessary to know the position of the substantially localized contact 26 since the substantially localized contact 26 can be located anywhere on the added-on part 23. The position of the substantially localized contact 26 is a function of the position of the ramp 30 and therefore, of the angular orientation of the pusher 12 around the central longitudinal axis 10 of the body 1. However, once all of the pusher 12, the elastic element or helical spring 35, the varying-diameter cylindrical member 20, and the added-on part 23 are assembled, this angular orientation or position of the pusher 12 has no influence on the operation of the device.

FIG. 3 again shows the same structural elements. This time, the pusher 12 has been completely depressed downwardly along the central longitudinal axis 10 of the body 1 until the elastic element or helical spring 35 is compressed to the maximum. Advantageously, the varying-diameter cylindrical member 20 is provided with a stop 40. The stop 40 stops the downward travel of the pusher 12 along the central longitudinal axis 10 of the body 1. As an alternative, the stop 40 could also be provided on the body 1. The operating button 7 of the switch 3 is thus in the released position, as shown in FIG. 2.

The shape of the ramp 30, shown in the different figures, is such that the movement of the operating button 7 of the switch 3 is obtained on a small part of the travel of the pusher 12. More specifically, the operating button 7 of the switch 3 is released at the very beginning of the downward travel of the pusher 12 when the end 25, of the second finger 24 of the varying-diameter cylindrical member 20, moves along the countersunk feature 33. Of course, it is possible to give the ramp 30 any shape enabling the activation of the operating button 7 at another position of the pusher 12. It is also possible to obtain variations in the speed of actuation of the operating button 7 with respect to the speed of movement of the pusher 12 by modifying the slope of the countersunk feature 33.

What is claimed is:

1. A device for amplifying movement of an operating button of a switch, said device comprising:

a body in which said switch is fixed;

a pusher located within said body for translating back and forth along a central longitudinal axis of said body such that a translation of said pusher, with respect to said body, constitutes an amplified motion;

a varying-diameter cylindrical member located within said body adjacent to an end of said pusher, wherein said varying-diameter cylindrical member includes:

a first support region movable along a ramp of said pusher when said pusher translates back and forth along said central longitudinal axis of said body;

a second support region, in permanent contact with a region of said body whatever a position of said pusher; and a third support region in contact with said operating button of said switch; and a single elastic element, wherein said single elastic element is a helical spring which maintains contact of said first support region with said ramp, of said second support region with a region of said body, and of said third support region with said operating button of said switch, said helical spring having a central longitudinal axis which is substantially coincident with said central longitudinal axis of said body, and said helical spring being positioned between said pusher and a flange of said varying-diameter cylindrical members.

2. The device according to claim 1, wherein said varying-diameter cylindrical member pivots about any point of said region of said body when said pusher moves along said central longitudinal axis of said body.

3. The device according to claim 1, wherein a shape of said ramp of said pusher is such that said movement of said operating button of said switch is effected by a small displacement of said translation of said pusher.

4. The device according to claim 1, wherein said varying-diameter cylindrical member is substantially generated by revolution and wherein said varying-diameter cylindrical member has a first finger such that an end of said first finger of said varying-diameter cylindrical member forms said third support region against said operating button of said switch, a flange forming said second support region against said body, and a second finger having an end forming said first support region against said ramp of said pusher.

5. The device according to claim 4, wherein said ramp of said pusher is made by a bore having a central longitudinal axis which is substantially parallel to said central longitudinal axis of said body along which said pusher translates, said bore including a smooth, cylindrical blind hole and opening due to a countersunk feature.

6. A device to amplify movement of an operating button of a switch, said device comprising:

a body in which said switch is fixed;

a pusher located within said body for translating back and forth along a central longitudinal axis of said body such that a translation of said pusher, with respect to said body, constitutes an amplified motion;

a varying-diameter cylindrical member located within said body adjacent to an end of said pusher, wherein said varying-diameter cylindrical member includes:

a first support region movable along a ramp of said pusher when said pusher translates back and forth along said central longitudinal axis of said body;

a second support region, in permanent contact with a region of said body whatever a position of said pusher; and a third support region, in contact with said operating button of said switch, wherein said varying-diameter cylindrical member is substantially generated by revolution and wherein said varying-diameter cylindrical member has a first finger such that an end of said first finger of said varying-diameter cylindrical member forms said third support region against said operating button of said switch, a flange forming said second support region against said body, and a second finger having an end forming said first support region against said ramp of said pusher.

7. The device according to claim 6, wherein said varying-diameter cylindrical member pivots about any point of said region of said body when said pusher moves along said central longitudinal axis of said body.

8. The device according to claim 6, wherein a shape of said ramp of said pusher is such that said movement of said operating button of said switch is effected by a small displacement of said translation of said pusher.

9. The device according to claim 6, wherein said ramp of said pusher is made by a bore having a central longitudinal axis which is substantially parallel to said central longitudinal axis of said body along which said pusher translates, said bore including a smooth, cylindrical blind hole and opening due to a countersunk feature.

10. The device according to claim 6, further comprising a single elastic element, wherein said single elastic element is a helical spring which maintains contact of said first support region with said ramp, of said second support region with a region of said body, and said third support region with said operating button of said switch.

11. The device according to claim 10, wherein said helical spring has a central longitudinal axis which is substantially coincident with said central longitudinal axis of said body, said helical spring being positioned from a top thereof to a bottom thereof between said pusher and a flange of said varying-diameter cylindrical member, respectively, and said helical spring being configured to apply a compressive force to said pusher to cause an annular flange, which extends outwardly from a main outer periphery of said pusher, to approach an inner shoulder of said body.

* * * * *